US005941375A

United States Patent [19]

Kamens et al.

[11] Patent Number: 5,941,375

[45] Date of Patent: Aug. 24, 1999

[54] DEVICE FOR PROTECTING MAGNETIC CARDS AND METHOD OF MAKING SAME

[75] Inventors: Adam M. Kamens, Philadelphia, Pa.; Paul B Rosenberg, Boca Raton, Fla.

[73] Assignee: Kamens, L.L.C., Wilmington, Del.

[21] Appl. No.: 08/996,032

[22] Filed: Dec. 22, 1997

[51] Int. Cl.[6] ..... B65D 75/28

[52] U.S. Cl. ..... 206/38; 206/39; 206/449; 150/147

[58] Field of Search ..... 206/449, 37, 38, 206/39, 39.5, 39.6, 459.5, 776, 782; 40/661; 150/131, 147

[56] References Cited

U.S. PATENT DOCUMENTS

| | | | |
|---|---|---|---|
| 3,958,690 | 5/1976 | Gee, Sr. | 206/38 |
| 4,593,736 | 6/1986 | Morita . | |
| 4,700,840 | 10/1987 | Haddock | 206/37 |
| 4,711,347 | 12/1987 | Drexler et al. | 206/38 |
| 4,722,376 | 2/1988 | Rhyner | 206/37 |
| 4,805,680 | 2/1989 | Ueno | 206/37 |
| 4,851,610 | 7/1989 | LeBlanc et al. . | |
| 4,974,652 | 12/1990 | Lemler . | |
| 5,080,223 | 1/1992 | Mitsuyama | 206/37 |
| 5,288,942 | 2/1994 | Godfrey . | |
| 5,609,253 | 3/1997 | Goade, Sr. | 206/449 |

*Primary Examiner*—Paul T. Sewell
*Assistant Examiner*—Luan K. Bui
*Attorney, Agent, or Firm*—Jacobson, Price, Holman & Stern, PLLC

[57] ABSTRACT

A protective card case or sheath for a single card having a magnetically encoded strip is in the form of a generally rectangular, flat, sleeve-type holder. The sheath has a protective strip along the top and bottom area of a front and rear panel for protection of the data encoded strip of a credit card or the like regardless of the orientation of the card in the holder. The protective strips thus shield the magnetically recorded data from magnetic and electric fields which might otherwise erase or damage such magnetically stored data. The card holder also includes a lengthwise centrally disposed transparent area in both the front and rear panel to enable observation of the identifying number imprinted on the card. The card holder also includes a screened area or stripe along the top and bottom areas of the front and rear panels on which informational material can be printed. The card holding device is constructed by cutting and sealing dies to cut and seal inner and outer layers of clear polyvinylchloride which are assembled and sealed to form front and rear panels which are then assembled and sealed along three edges with one edge left open for insertion and removal of the encoded card. A third transparent panel may also be sealed around three sides over the rear panel to form a pocket for receiving an information bearing card.

16 Claims, 7 Drawing Sheets

DEVICE FOR PROTECTING MAGNETIC CARDS AND METHOD OF MAKING SAME

BACKGROUND OF THE INVENTION

1. Field of the Invention

The present invention relates to a protective card holding case or sheath for a single wallet-sized card or the like, and a method of forming the card holding device. More particularly, the invention relates to a generally rectangular, flat, sleeve-type holding device which has a protective shield for protection of the magnetically encoded data strip on a credit or other type card.

2. Description of the Related Art

Plastic cards having magnetically stored data are widely used to perform a large variety of tasks, from being used as a conventional credit card, bank card or telephone calling card to use as a key to operate a door lock and the like. Such cards are typically uniform in rectangular size and configuration. An identifying number is typically printed and/or embossed in the central section on the front side of the card, and a signature area is typically positioned on the reverse side, often in the central area. Information particular to the user carrying the card is also typically stored as a magnetic strip located on the reverse side of the card near one longitudinal edge, usually above the signature area. In order to complete a given transaction or operation, the information stored in the magnetic strip on the card must be recognized by a card reader.

However, magnetically stored information may become inadvertently erased if the card on which such information is stored comes near devices that produce a magnetic force field, such as magnets, electric appliances, power supplies, motors, transmission lines, and the like. Magnetic and electromagnetic fields exist in a wide variety of forms, including light, television and radio waves. Moreover, as plastic cards become more commonplace, it is typical for a person to carry multiple cards, such as one or more bank cards, merchandise credit cards, telephone calling cards, gasoline credit cards, building access cards, as well as a myriad of other cards now used extensively in society. Consequently, magnetic strips are susceptible to becoming damaged or worn by coming into contact with other cards or objects.

Prior efforts have failed to produce a protective card holding case or sheath for magnetically encoded cards which provides the necessary protection to the magnetic strip or the like containing the encoded data or information, and which also allows one to read the credit card number while the card is still in the case or sheath. Other desirable features include appropriate size, thickness and weight for easy and convenient storage in conventional wallets in the same manner as an unsheathed card, and ready manufacture at a reasonably low cost.

In the prior patent art, LeBlanc U.S. Pat. No. 4,851,610 discloses protective strips formed from an amorphous alloy having a high saturation inductance incorporated into a card holding device. Morita U.S. Pat. No. 4,593,736 and Godfrey U.S. Pat. No. 5,288,942 disclose similar holders provided with a strongly magnetic mesh or keeper sheet, respectively, applied on one side of the card holding pocket. Finally, Lemler U.S. Pat. No. 4,974,652 discloses a holder for multiple credit cards. However, none of the prior protective card holding devices provides the requisite level of protection for the encoded magnetic strip regardless of the orientation of the card in the holder or sheath, has a structure which allows viewing of the credit card number, has the necessary compactness and lightweight characteristics and can be manufactured at a reasonably low cost.

SUMMARY OF THE INVENTION

Therefore, in accordance with the present invention, a generally rectangular, flat, thin, sleeve-type single card case or sheath is formed from a rectangular blank of clear plastic or other flat sheet material. The card holder has a front panel and a rear panel with an open side edge or an open top edge which enables a card having magnetically recorded data thereon to be inserted from the side or top of the holder. The remaining edges of the holder are sealed by any suitable sealing operation to form closed edges.

The electronically encoded card has the magnetic strip typically formed along one long edge of the card near the card edge. Hence, the card holder of the present invention includes a protective strip on the top and bottom areas of each front and rear panel so as to overlie and protect the magnetic encoded strip in any of the four positions in which the strip can be positioned in the holder. The card holding case or sheath thus shields the magnetically recorded data from magnetic and electric fields which might otherwise erase or damage such magnetically stored data regardless of the orientation of the card and the magnetic strip in the case or sheath. In the preferred form, the protective strip is formed of a high permeability strip, stamping or foil sealed between the two layers forming each front panel and rear panel.

The card holding device of this invention also includes a lengthwise centrally disposed transparent area in both the front and rear panels between the top and bottom protective strips so as to enable observation of an identifying number embossed or imprinted on the card and the signature of the card user, if centrally located, also regardless of the orientation of the card in the holder. The card holding device further includes an external opaque or color stripe screened along the top and bottom areas of the front and rear panels to cover the outside surface of the protective strip and to provide a background on which informational material can be printed, such as company names, logos and the like. Such informational material can be coordinated so that the card holding device is identified with the issuer of the credit card, telephone card or the like to be carried in the holder. The card holding device is preferably made from clear polyvinylchloride (PVC) sheeting and formed by cutting and sealing dies to form multiple card holding devices of this invention during each forming process.

In one embodiment of the present invention, the card holding device includes a third transparent plastic panel having approximately the same size and shape as the front and rear panels, which is positioned and sealed along three edges over the rear panel, with the fourth edge remaining open. The third panel forms a see through pocket with the rear panel for receiving an information card or the like through the open edge. By providing a pocket for receiving an informational card, the issuer or sponsor of the card holding device, which has its informational material printed along the top and/or bottom areas of the front panel, can also provide the user with updated information about use of the issuer's credit or other type card intended to be protected by the card holding device.

Accordingly, an object of the present invention is to provide a device for conveniently holding and protecting a single card encoded with a magnetic data strip adjacent an edge thereof which protects the card stored in the holder from magnetic and electric fields that may erase or damage the encoded strip.

Another object of the present invention to provide a protective card holding device that stores a credit or similar card in a generally rectangular, flat, thin, compact and lightweight sleeve-type case or sheath and which can be easily and conveniently inserted into a standard wallet in the same manner that the encoded card is inserted into the wallet.

A further object of this invention is to provide a protective holder in accordance with the preceding objects in which each of the front and rear panels includes an inner and outer layer with a strip of high permeability material sealed therebetween along both long edges of the panels, top and bottom, in order to protect the magnetically encoded data on the credit card regardless of the orientation of the magnetic strip in the protective holder.

Still another object of this invention is to provide a protective card holder in accordance with the preceding object which also includes a lengthwise centrally disposed transparent area in the front and rear panels which enables viewing of the identifying number embossed or printed on the card and the signature of the card user, if centrally positioned, also regardless of the orientation of the card in the holder.

Yet a further object of the present invention is to provide a credit card case or sheath and method of making same in accordance with the preceding objects in which each of the front and rear panels includes an opaque or color area covering the outside surface of the protective strips, along the top and bottom outer surface of each of the panels, which is conducive to being printed on to enable a company name, logo, instructions or other material to be printed thereon.

Yet another object of the present invention is to provide a credit card case or sheath which protects the magnetic data strip of the card stored in the holder regardless of the orientation of the card therein and also provides an additional pocket for receiving a replaceable information card so that the holder can periodically carry updated information regarding use of the credit or other type card intended to be stored in the holder.

A still further object of the present invention to provide a protective card holding device which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
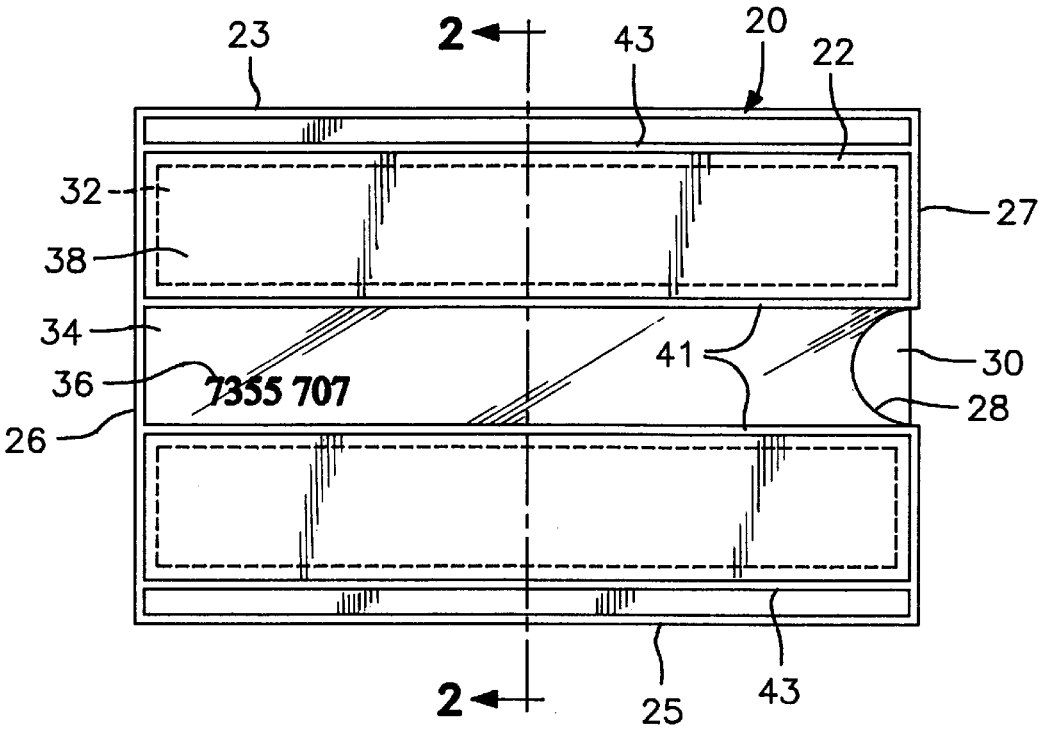
FIG. 1 is a top plan view of a side opening protective card holding device in accordance with the present invention.

Although only two preferred embodiments of the invention are illustrated and explained in detail, it is to be understood that the invention is not limited in its scope to the details of construction and the arrangement of components set forth in the following description or illustrated in the drawings. The invention is capable of other embodiments and of being practiced or carried out in various ways. Also, in describing the preferred embodiments, specific terminology will be resorted to for the sake of clarity. It is to be understood that each specific term includes all technical equivalents which operate in a similar manner to accomplish a similar purpose.

Figure 2:
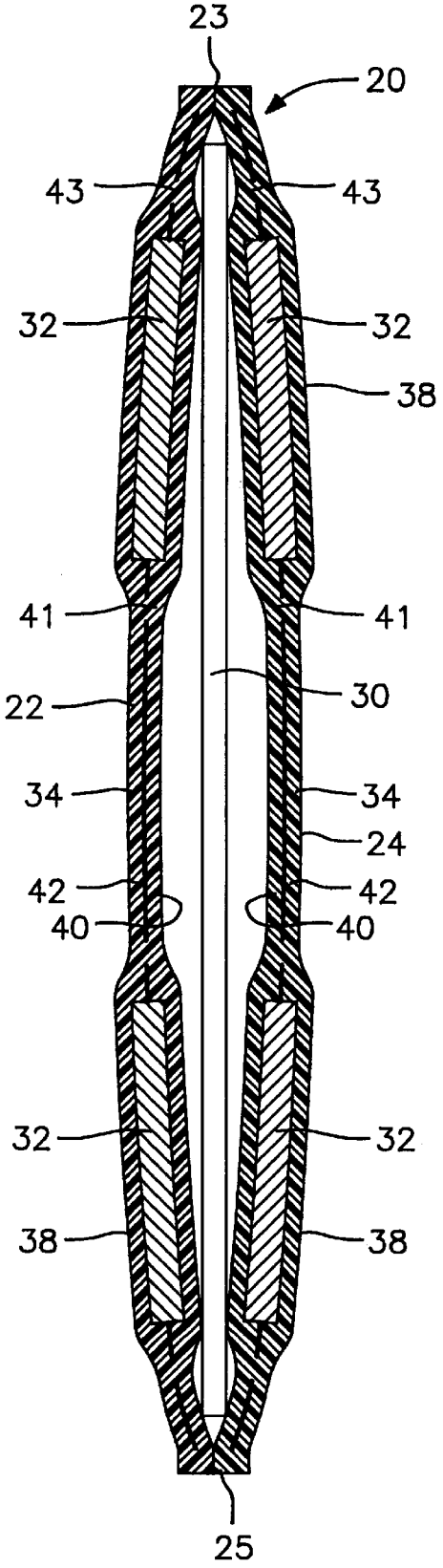
FIG. 2 is a transverse sectional view, on an enlarged scale, taken along section line 2—2 on FIG. 1 with the card shown in solid lines.

FIGS. 1 and 2 illustrate the structure of a generally rectangular, flat, thin, sleeve-type credit card holding device generally in the form of a case or sheath, designated generally by reference numeral 20. The holding device 20 includes a rectangular front panel 22 and a rectangular rear panel 24 made from a suitable transparent plastic sheet material. Any suitable plastic sheet material can be used, but PVC is preferred because of its transparency, durability, manufacturing properties and low cost.

The top edges 23 and bottom edges 25 of the front and rear panels 22 and 24 are sealed together, and one side edge 26 is sealed with the opposite side edge being open as indicated at reference numeral 27. The sealing of the PVC or other plastic sheeting material in accordance with the present invention can be accomplished in any known or conventional manner, such as RF sealing or heat sealing, with RF sealing preferred. Open side edge 27 includes a semicircular notch 28 in both front and rear panels 22 and 24 to facilitate insertion and removal of a credit or other type card 30 to be protected therein. The notches 28 enable the front and rear surfaces of the credit card to be grasped for removal when desired and also facilitate complete entry of the card into the card holding device.

Each of the front and rear panels 22 and 24 includes an elongated protective strip 32 in both the top and bottom areas thereof. The metal strips 32 are formed of a material that is capable of shielding the magnetic encoded strips or the like on a credit card 30 from becoming erased and is also noncorrosive, durable and flexible. The strips 32 can also function to protect the cards 30 from damage due to impacts and the like. Typically, strips 32 are made of a magnetic shielding metal that is permeable to magnetic fields and conductive to electrical fields to thereby protect the encoded strip on the card 30. In a preferred embodiment, the magnetic shielding metal is an aluminum killed cold rolled steel, which has been annealed, fully decarburized with a carbon content of less than 1%. The material is preferably ultra flat with an isotropic surface. One such material is commonly known as 1001 Ultra Low Carbon Steel for use in magnetic shielding applications. However, any suitable alloy or other protective material having high permeability to magnetic fields and high conductivity to electrical fields may be used.

Other known suitable alloys comprise primarily nickel, such as Ni—Fe alloys having a 48% or 80% nickel content. These Ni—Fe metal alloys are available, for instance, from Amuneal Manufacturing Corp. of Philadelphia, Pa. The metal strips 32 may be in the form of a formed strip or stamping or a foil or other material which can be laminated in place on the PVC or other suitable plastic sheet material during the forming of the holder 20.

The metal strips 32 extend substantially from side edge to side edge and have a narrow width, extending a distance to completely cover the width of the magnetic strip on the card protected in the holding device 20. As illustrated in the drawings, the elongated metal strips 32 have one long edge adjacent a long edge 23, 25 of the card holder 20 and extend approximately one third the width of the card holding device.

Opaque or color areas 38 then cover the entire top and bottom areas of both the front and rear panels 22 and 24 to cover the elongated metal strips 32. Preferably, the color area extends from one side edge 26 to the other side edge 27 and to the top edge 23 or bottom edge 25, as the case may be. Thus, an open transparent area 34 is provided in each panel between the metal strips 32. This transparent area 34 lines up with the identifying account number 36 or telephone calling card number typically on the front of the card. Also, when the signature of the card holder typically on the rear of the card is positioned centrally, the signature can also be seen when the card is properly positioned within the case or sheath. Accordingly, when properly positioned in the card holding case or sheath, the identifying account number 36 can be seen through the transparent areas 34 of the front or rear panels 22 and 24 regardless of the orientation of the card in the card holder. Similarly, if the signature of the card holder is positioned centrally on the rear of the card to be protected in the holder, the signature can also be seen through the transparent areas 34 of the front or rear panels 22 and 24.

The exterior of each of the front and back panels 22 and 24 is preferably provided with an opaque or color area 38 on which a company name, logo or other material may be printed. The color area 38 at both the top and bottom areas of each of the front and rear panels is larger than the protective metal strip 32 so as to hide the metal strip 32 inside the panels 22 and 24 and preferably covers the entire top and bottom areas from side edge 26 to side edge 27 and to the top edge 23 or bottom edge 25. However, the color areas need not extend fully to the side edges 26, 27 or top or bottom edges 23, 25.

Each of the front and rear panels 22 and 24 is preferably constructed of two substantially identical layers comprising an inner layer 40 and an outer layer 42. The four protective metal strips 32 are sandwiched between the inner layer 40 and the outer layer 42 at the prescribed location in the top and bottom areas of the front and rear panels 22 and 24, and the layers 40 and 42 are sealed together around the metal strips 32. In particular, the top and bottom edges of the layers 40 and 42 which make up the top and bottom edges of the front and rear panels 22 and 24 are sealed at the periphery thereof, and the side edges of layers 40 and 42 which make up the side edges 26 of the front and rear panels are also sealed completely across the side edge. The inner and outer layers of each of the front and rear panels are separately sealed along the open edge 27 and along inner and outer retaining seals 41 and 43.

By this sealing arrangement, the metal strips 32 are sealed in the top and bottom areas of the front and rear panels 22 and 24, while at the same time the front and rear panels 22 and 24 can separate along open edge 27 for insertion of card 30. When all of the sealing operation has been completed, the front and rear panels can be flexed slightly apart along open side edge 27 by exerting inward pressure on the top and bottom edges 23 and 25 adjacent the edge 27 to open the edge and facilitate insertion and removal of the credit card. The transparent area 34 enables the account number, telephone calling card number or the like that is formed along the central area of the card 30 to be readily observed and other information in that area, such as the signature of the card holder, if centrally located, may also be readily observed. The account number and signature will be observed from either the front or back of the card holder 20 depending upon the manner in which the card has been inserted.

Likewise, with the four metal strips, two in the front panel at the top and bottom areas and two in the rear panel at the top and bottom areas, the magnetic encoded data on the credit or other type card will be protected regardless of how the card is inserted into the holding device. Likewise, the four opaque or color areas 38 enable information, instructions, company names, logos and the like to be printed so that they can be observable regardless of how the credit card holder is positioned.

In one embodiment of the holder 20, the protective strips 32 are flexible metal strips which can be inserted between layers 40 and 42 after forming inner and outer seals 41 and 43 and closed edge 26, but before sealing open edge 27. Alternatively, edge 27 can be sealed first before edge 26, depending upon the manufacturing process for forming and sealing the protective card holder 20. In either event, one edge, edge 26 or 27, is sealed first to form the metal strip pocket, the metal strip is inserted and the other side edge is sealed to form a complete seal around each of the four protective metal strips 32.

In another embodiment, the protective strips 32 can be formed by a metallic foil or other material laminated at the appropriate location on the plastic sheeting material forming layer 40 or layer 42 before these layers are sealed together. Preferably, the protective metal foil or other material is laminated on the side of layer 40 or layer 42 which faces the other layer so that the foil or laminate is sandwiched between the two layers 40 and 42 in the final assembly. Similarly, while the opaque or color coating or laminant can be applied on the outside of outer layer 42 of each of the front and rear panels 22 and 24, and the informational material, such as company name, logo, etc. then printed thereon, the information material and color laminant can be screened on or applied to the inner surface of the outer layer 42, so long as the informational material can be seen from the outside of the front and rear panels.

Figure 3:
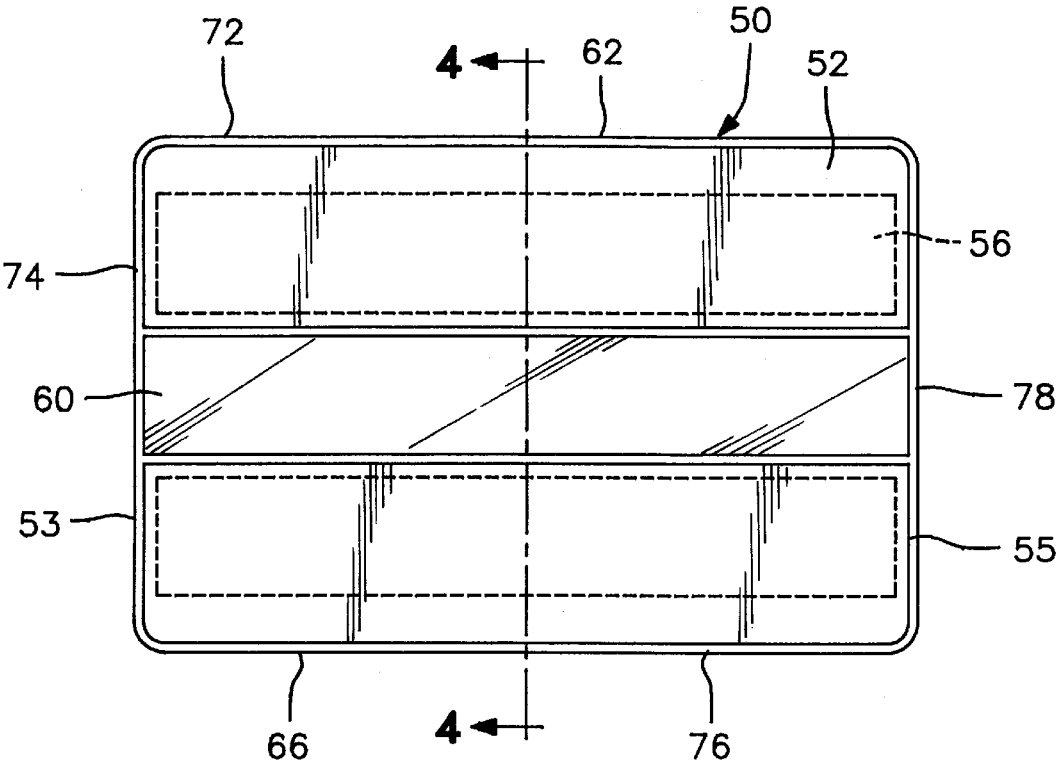
FIG. 3 is a top plan view of a top edge opening card holder in accordance with the present invention.
Figure 4:
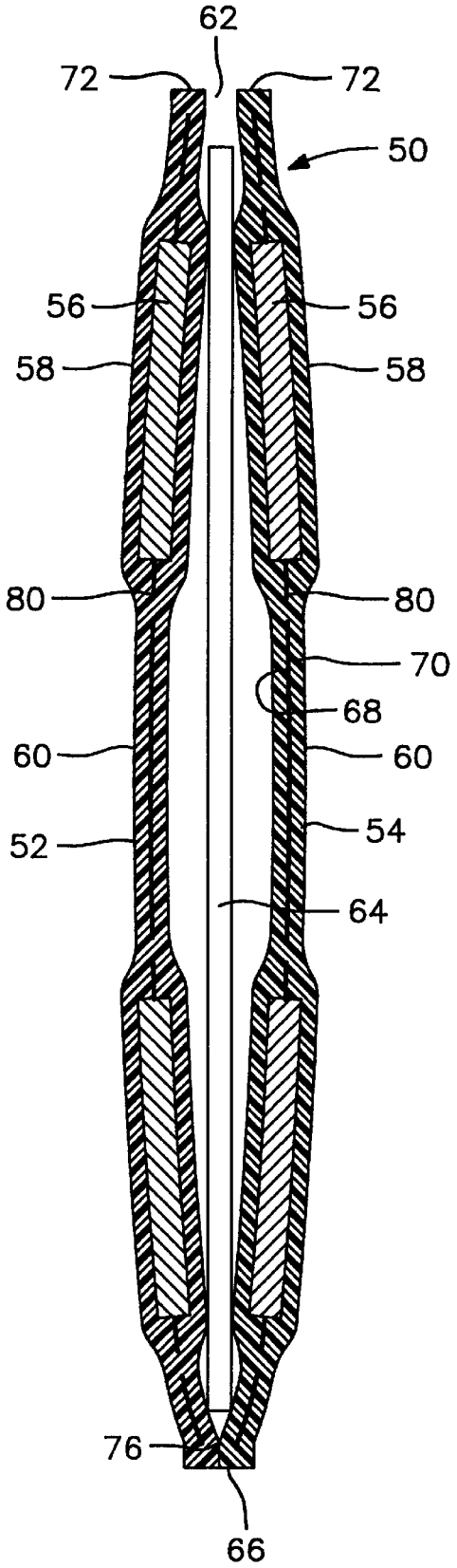
FIG. 4 is a transverse, sectional view, on an enlarged scale, taken along section line 4—4 on FIG. 3 with the card shown in solid lines.

FIGS. 3 and 4 illustrate another embodiment of the card holding device of the present invention, generally designated by reference numeral 50. This holder 50 also includes a front panel 52 and a rear panel 54 of substantially identical rectangular construction. Each of the front and rear panels 52 and 54 are also provided with protective strips 56 and opaque or color stripes 58 along both the top and bottom edge portions of the card holder, thus leaving a central portion of both the front and rear panels with a transparent central area 60 extending from side edge 53 to side edge 55. In this embodiment of the invention, the top edge 62 of the card holding device is open from one side edge to the other to enable the credit card 64 to be inserted downwardly into the credit card holder. The protective strips 56 are formed of the same material as protective strips 32 of the FIGS. 1 and 2 embodiment and must be capable of shielding the magnetic encoded strips or the like on the card to be inserted into the holder 50 from becoming erased. Preferably, the protective strips 56 are made from a metallic alloy which is noncorrosive, durable and flexible and may be a metallic foil or other material which can be laminated to the plastic sheeting material, such as the PVC sheeting preferred for this invention.

In this construction, the top and bottom edges 62 and 66 are also the elongated sides and the side edges 53 and 55 are relatively shorter. In addition, both the front and rear panels 52 and 54 are constructed of inner and outer layers 68 and 70, respectively, which are sealed along their entire perimeter as indicated by numerals 72, 74, 76 and 78. However, the top edge 62 of the card holder is open, that is, the top edge of the front and rear panels 52 and 54 are not attached even though the top edge of inner and outer layers of each of the panels are sealed together, as at 72. Inner seals 80 between the inner and outer layers 68 and 70 of each of the front and rear panels 52 and 54 together with the peripheral edge seals serve to completely enclose the metal strips 56.

This embodiment of the invention functions in the same manner as that illustrated in FIGS. 1 and 2 inasmuch as the transparent area 60 enables observation of the account number and signature of the card user, if centrally located, regardless of the manner in which the credit or other type card is inserted. The identifying account number, telephone calling card number or the like on the face of the card, and the signature of the card user on the rear of the card if centrally located, will be observable through either the transparent area 60 in the front panel 52 or the transparent area 60 in the rear panel 54. Likewise, the magnetic encoded data strip on the credit or other card will be protected regardless of the orientation of the card within the holder since there are four protecting metal strips 56, one each along the top and bottom areas of each of the front and rear panels 52 and 54. Therefore, regardless of how the card is oriented in the holder, there will be a protective metal strip covering the magnetic encoded data strip of the encased card. Similarly, informational material may be printed or screened on the opaque or color areas along the top and bottom areas of the panels 52 and 54 to be read by anyone holding the holder 50.

Figure 5:
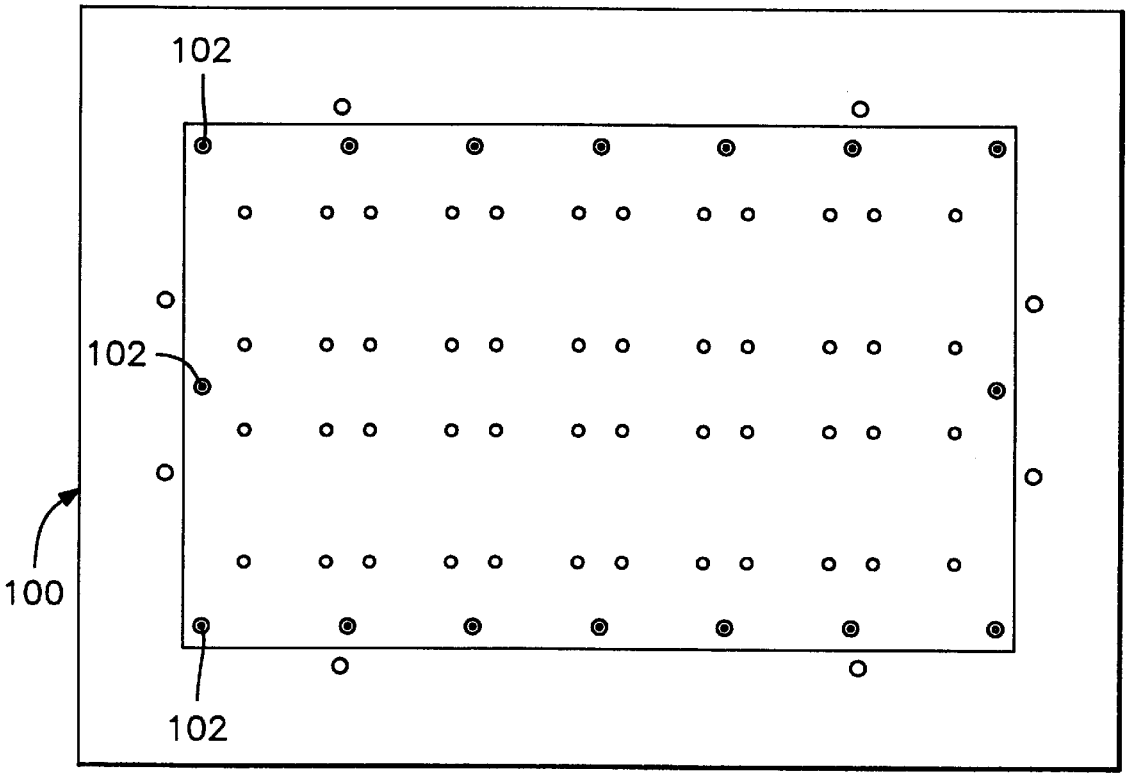
FIGS. 5–13 illustrate a method in accordance with the present invention for forming the side opening credit card holder of FIGS. 1 and 2.
Figure 6:
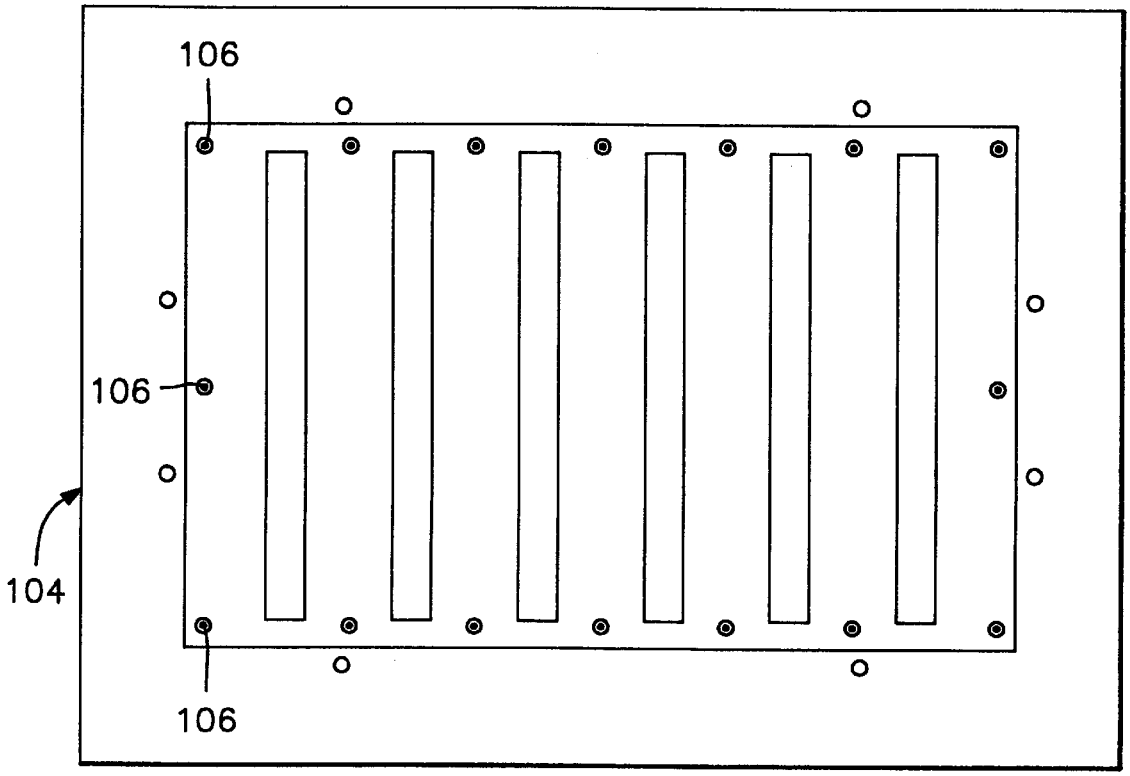
Figure 7:
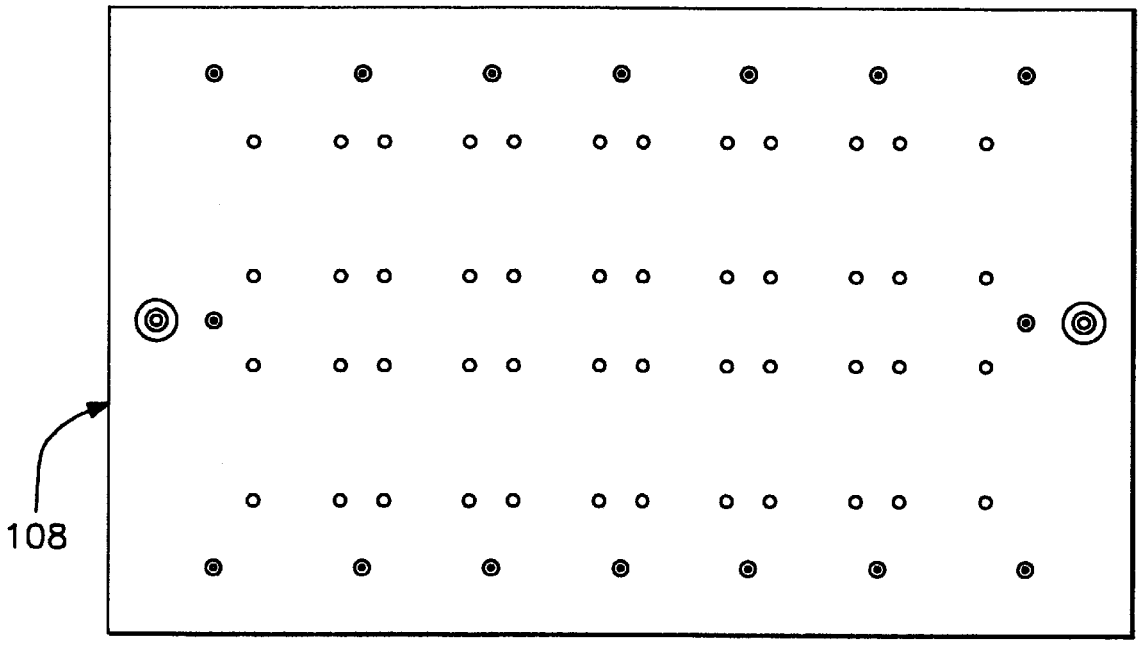

A method for making a card holder of the present invention will now be described. Clear polyvinylchlorine (PVC) having a nominal thickness between about 0.006 inches to about 0.010 inches and which has been roller polished is preferably used. This material is commercially available in a coil or roll having a width of 54 inches and a length of 300 feet. In making the FIG. 1 and 2 embodiment, this sheet material is removed from the coil and can be formed into a sheet that is 54 inches wide and 36 inches long. The 36 inch by 54 inch sheet of PVC is then cut or knifed into four pieces each being 13½ inches wide by 36 inches long. These sheets are used to form the outer layer 42 and inner layer 40 of the front panel 22 and rear panel 24. The 13½ inch wide by 36 inch long sheet which forms the outer layer 42 will be die cut to add ¼ inch diameter locating holes that will be used for the silk screening and sealing operations. FIG. 5 illustrates the cutting die 100 for the clear sheet including punches 102 for forming the ¼ inch locating holes in the sheets. FIG. 6 illustrates the outer layer cutting die 104 which also includes punches 106 that register with the locating holes formed by punches 102 in the sheet.

The inner layer 40 is formed in the same manner as the outer layer 42. After cutting or knifing, the inner layer is positioned on top of the outer layer using the die cut locating holes formed by the punches 102 and 106. Appropriate color coating and informational material is silk screened or otherwise printed on the outer layer in the selected top and bottom areas preferably before alignment with the inner layer. Typically, the silk screening or printing operation is carried out in two steps, one being the application of the opaque or color background and the other being the application of the information material.

Figure 8:
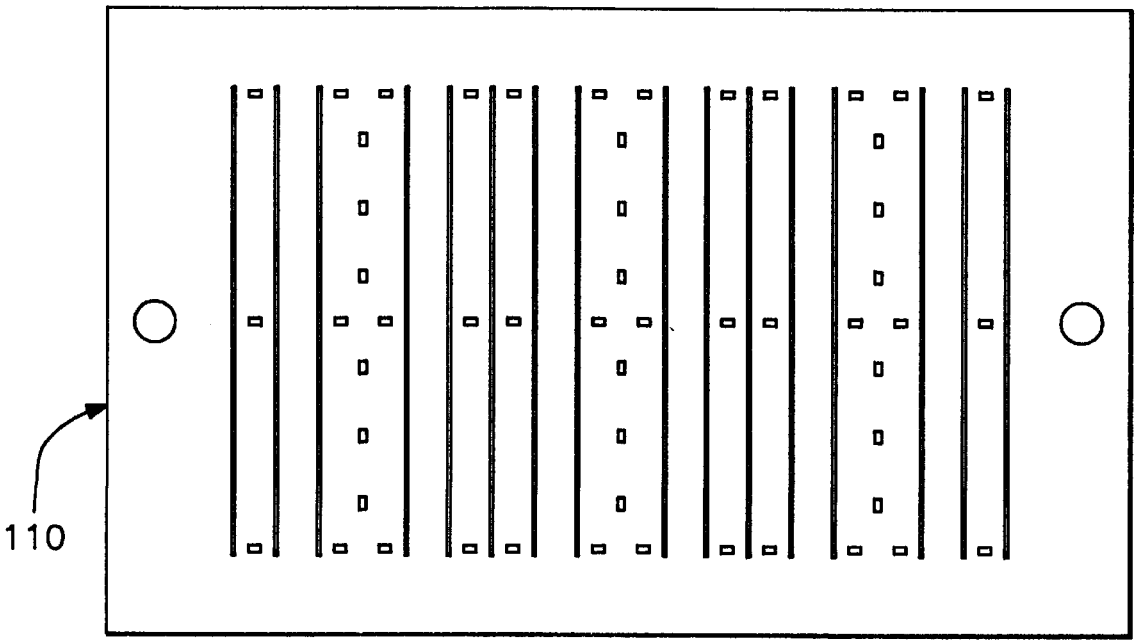

In the assembly of the outer layer 40 and inner layer 42, a seal pin plate 108 is used to orient the upper and lower layers and a first sealing die 110 illustrated in FIG. 8 is used to seal the inner and outer layers along all the open edges except the side opposite the thumb notch 28 to create pockets for the metal strips or shims 32. The pockets for the metal strips or shims 32 are thus left open along side edge 26. The metal strips or shims 32 are then inserted into the shim pockets. At this point, two multiple blanks that have already been through the first sealing operation and have the metal strips or shims 32 inserted therein to form the front and rear panels are laid on top of one another and oriented using locating pins so that the silk screened area on each panel faces outwardly and the metal strips or shims 32 are oriented closest to each other.

Figure 9:
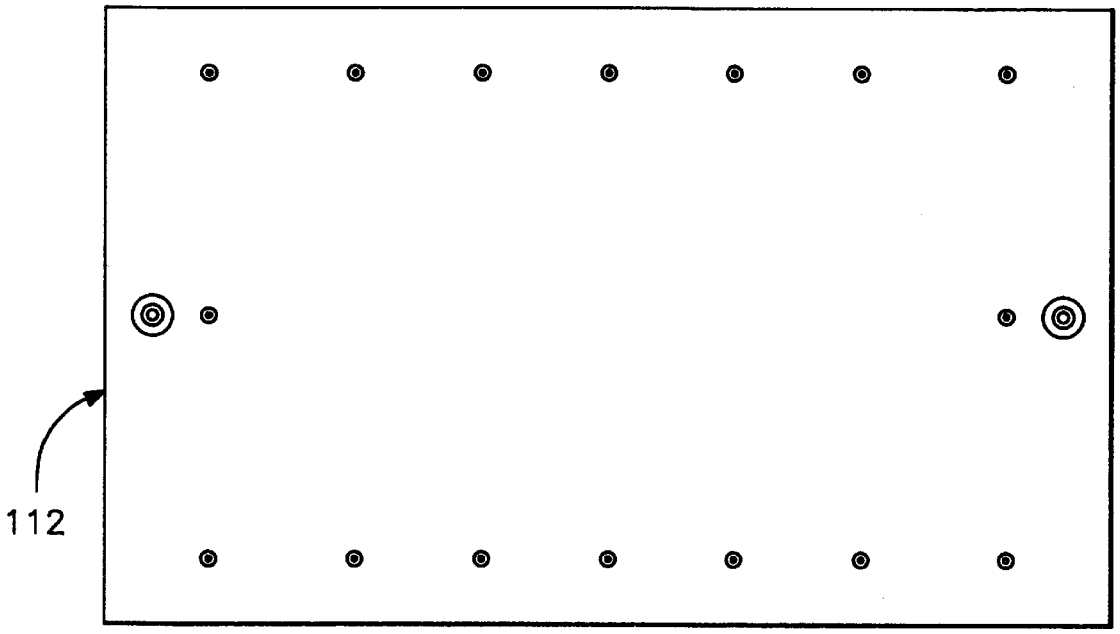
Figure 10:
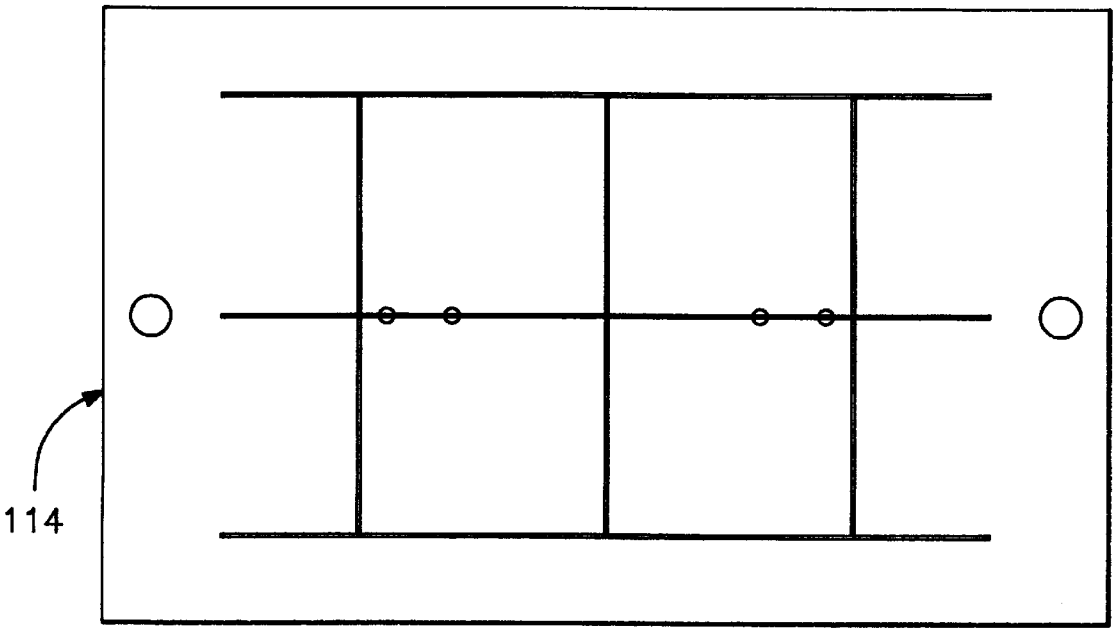

The overlying multiple blank arrangement forming the front and rear panels 22 and 24 then go through a final seal operation including a second seal pin plate 112 illustrated in FIG. 9 and a perimeter sealing die 114 illustrated in FIG. 10. The final seal operation seals the three open sides of the front and rear panels 22 and 24 thus forming a complete card pocket and sealing the metal strips or shims 32 in on all sides. The individual card holders 20 are stripped from the multiple blank with the scrap material having the registration holes being removed and discarded. The dimensional characteristics of the sheets forming the outer and inner layers provide twelve complete card holders which then can be inspected and packed into appropriate packaging. The dimensional characteristics of the sheets forming the inner and outer layers and thus forming the front and rear panels can vary to enable the production of a different number of card holders during each cutting, assembling and sealing operation.

Figure 13:
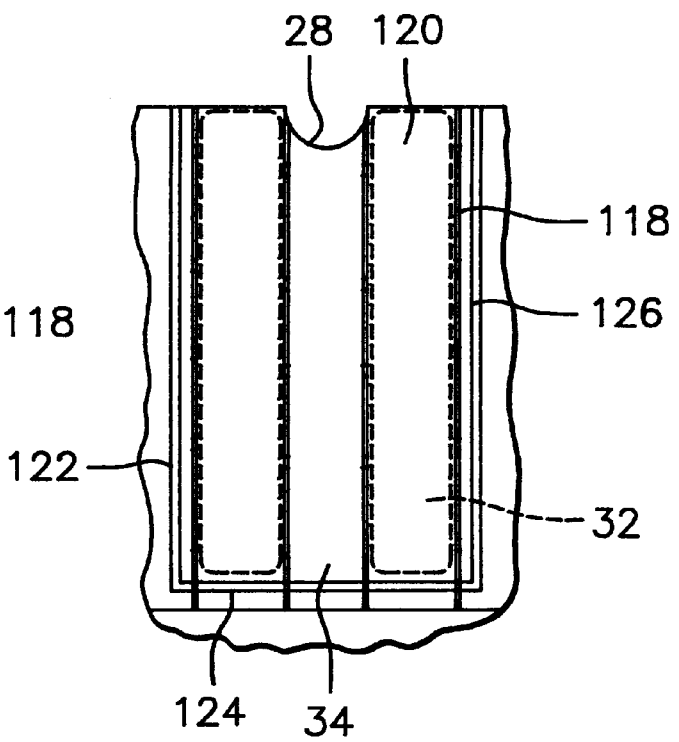
Figure 12:
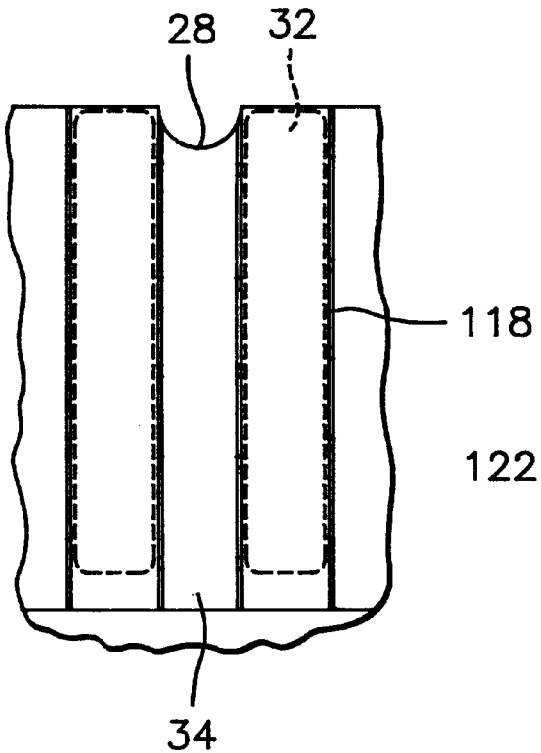
Figure 11:
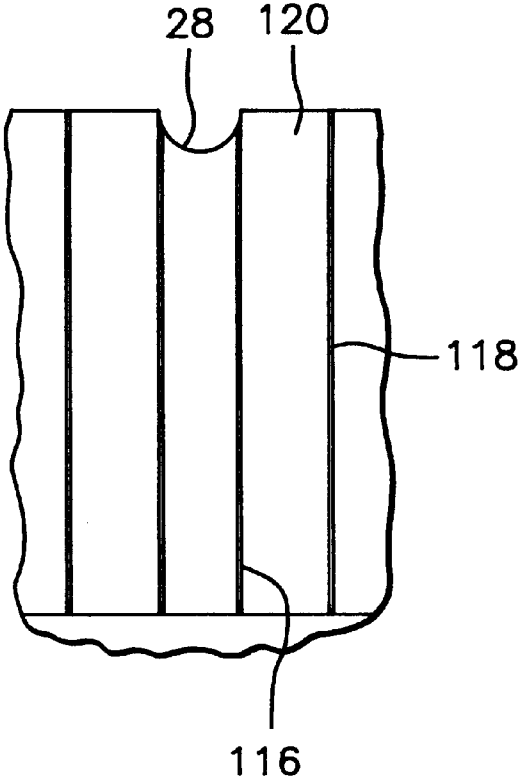

FIGS. 11, 12 and 13 illustrate the assembly of the sheets forming the inner and outer layers of panels 22 and 24. In FIG. 11, the layers have been provided with locating seals 116 and 118 which form the pockets for the metal strips on each side of the finger slot 28. The top layer 120 is silk screened and the bottom surface of the lower layer will have the area defining the metal strip pocket screened by stamping. FIG. 12 illustrates the metal strips or shims 32 inserted into the pockets, and FIG. 13 illustrates two sets of inner and outer layers assembled with screening 120 on the outside, the finger notches 28 aligned and three sides of the perimeter of each assembly sealed at 122, 124 and 126, which are outwardly of the seals 118 forming the pockets for the metal strips 32. Each completed card holder is then stripped from the scrap.

The completed card holder 20 includes individual seals around the perimeter of the metal strips or shims 32 to form the front and rear panels and when the front and rear panels are assembled, three side edges of the front and rear panels are sealed together and the side edge 27 of the front and rear panels having the notches 28 therein are left open to enable a credit card, telephone calling card or the like to be inserted therein. In forming the embodiment of the credit card illustrated in FIGS. 3 and 4, the inner and outer layers, the metal strip pockets, transparent areas, silk screen areas and open top edge are formed by changes in the cutting and sealing procedure by different orientations of the cutting dies, pin plates and sealing dies.

Alternatively, it may be possible to laminate the protective strip in the form of an appropriate metal foil or the like onto the PVC or other plastic sheeting prior to the forming of the inner and outer layers into the panels 22 and 24. Similarly, the informational material and opaque or color background or covering can also be printed or silk screened onto the PVC or other plastic sheeting at appropriate locations before forming the inner and outer layers into the panels. In the event that the printing and background or covering color are located on the inside of the outer layer, with the instructional material observable through the transparent outer layer, the informational material and color coating will be protected from scratching and wear by the thickness of the outer layer.

Figure 15:
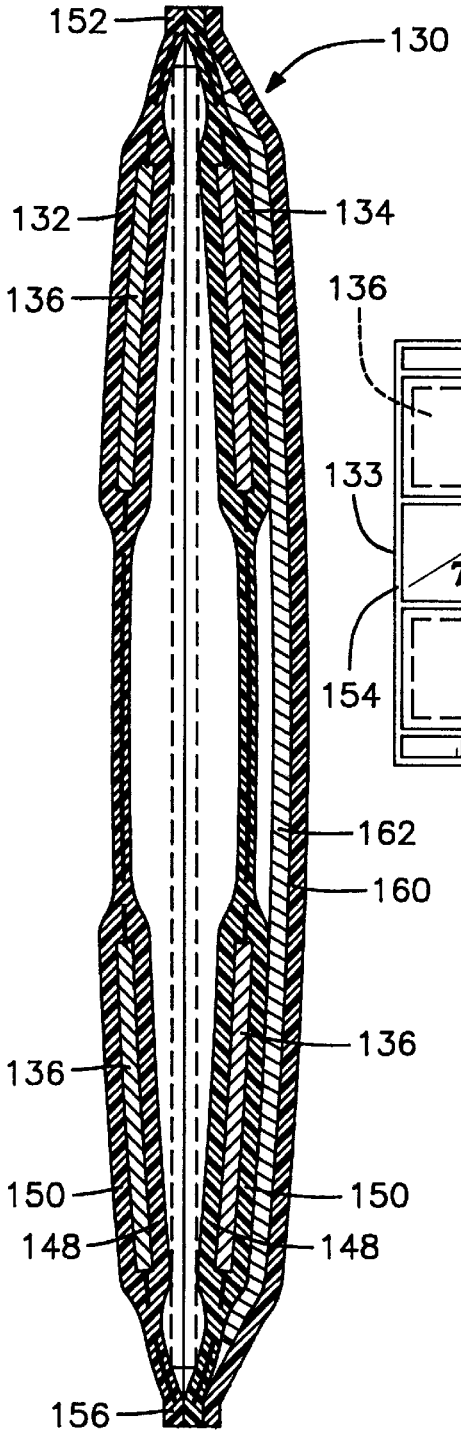
FIG. 15 is a transverse sectional view, on an enlarged scale, taken along section line 15—15 on FIG. 14 with the protective card shown in broken lines and the information sheet shown in section.
Figure 14:
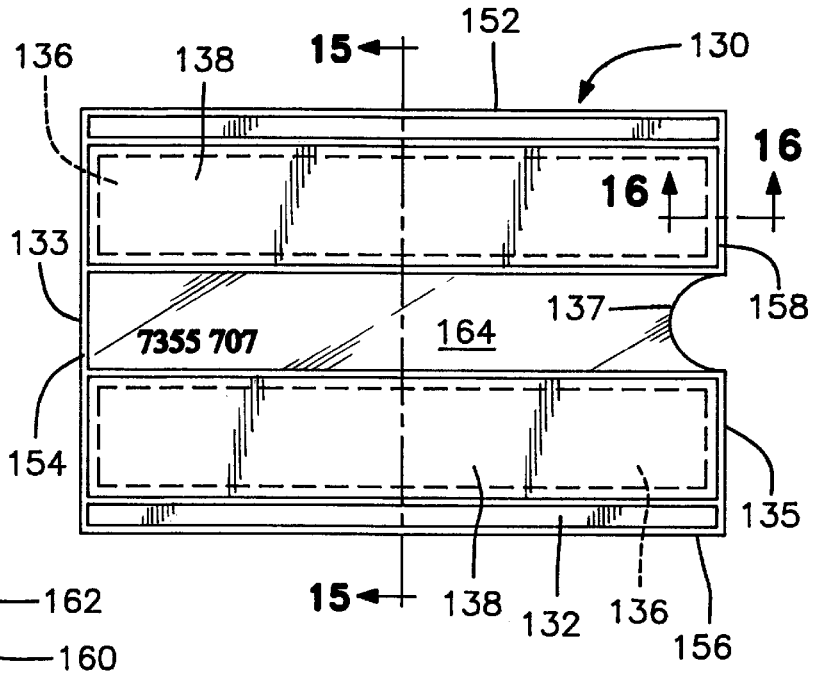
FIG. 14 is a top plan view of another embodiment of a side opening protective card holding device in accordance with the present invention.
Figure 16:
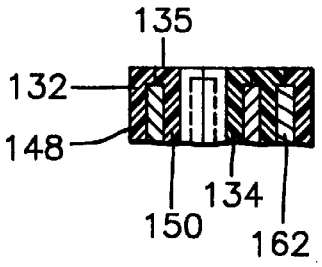
FIG. 16 is a transverse sectional view, on an enlarged scale, taken along section line 16—16 on FIG. 14.

A further embodiment of the card holding device of the present invention is illustrated in FIGS. 14–16 and generally designated by the reference numeral 130. This holder 130 also includes a front panel 132 and a rear panel 134 of substantially identical rectangular construction. In this third construction, the top and bottom edges 152 and 156 are also the elongated sides and the sides 133 and 135 are relatively shorter. The front and rear panels 132 and 134 are constructed of inner and outer layers 148 and 150, respectively, which are sealed along their entire perimeter as indicated by numerals 152, 154, 156 and 158. The front and rear panels are also sealed together along seals 152, 154 and 156, leaving an opening along edge 135 for insertion of a credit card, telephone card or the like.

Each of the front and rear panels 132 and 134 are provided with the four protective strips 136 in the same manner as previously described with respect to holders 20 and 50. The protective strips 136 are formed of the same material as protective strips 32 of the FIGS. 1 and 2 embodiment and strips 56 of the FIGS. 3 and 4 embodiment. Strips 136 must be capable of shielding the magnetic encoded strips or the like on the credit or other card to be inserted into the holder 130 from becoming erased.

However, in this embodiment of the invention, a third transparent plastic panel 160, preferably having substantially the same rectangular size and shape as inner and outer layers 148 and 150, is sealed to the outer layer 150 of rear panel 134 around the periphery of three sides in order to form a second pocket in the card holder. Preferably, the third panel 160 is sealed along top and bottom edges 152 and 156 and side edge 135 in which notch 137 is formed. The fourth side of panel 160 is left unsealed from the outer layer 150 along edge 133 to allow the insertion of an information card 162 within the pocket. As such, the opening in edge 133 for information card 162 is opposite the opening in edge 135 for the credit or other type card.

As illustrated in FIG. 14, the card 162 also preferably has a notch which corresponds to notch 137 so that when the card 162 is fully inserted in the pocket formed by the third panel 160, the leading edge of the card does extend into the notch 137. The third plastic panel 160 is transparent so that information printed on the card can be readily seen through the panel 160 when inserted in the pocket.

In this embodiment of the invention, the opaque or color background stripes 138 along both the top and bottom edge portions are preferably included only on the front panel 132, inasmuch as the card 162 serves to cover the exposure of the protective strips 136 through the rear panel 134. In addition, no purpose would be served by having printed information material on the rear panel, as well. Further, only the central portion of the front panel is provided with a transparent central area 164 extending from side edge 133 to side edge 135.

This embodiment of the invention functions in the same manner as the previous embodiments inasmuch as the transparent area 164 enables observation of the account number, regardless of the manner in which the credit or other type card is inserted, so long as the card is inserted with the account number facing the front panel 132. Moreover, the magnetic encoded data strip on the credit or other card will be protected in holder 130 regardless of the orientation of the card within the holder since there are four protecting metal strips 136, one each along the top and bottom areas of each the front and rear panels 132 and 134.

The advantage of this third embodiment allows an issuer or sponsor of the card holding device to provide informational material on the rearwardly facing side of card 162. For example, the sponsor of the card intended to be held in holder 130 can provide information on card 162 regarding dialing instructions for long distance telephone access to be charged with the subject credit card. As additional services become available by the sponsoring entity, new cards 162 can be provided with the information printed on card 162 upgraded for replacement in the pocket formed by the third panel 160.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A protective holding device for a member having magnetically encoded data in a specific area thereof, said holding device comprising an enclosure having an open edge receiving said member, said enclosure including a protective area in registry with said specific area having magnetically encoded data for protecting the encoded data from magnetic and electromagnetic fields that could alter said encoded data, said enclosure being generally rectangular, thin and flat and including a front and rear panel forming a sheath type construction, one edge of said enclosure being open for insertion of said member, said member being a generally rectangular card having data encoded as a strip extending substantially throughout the length of the card adjacent a long edge thereof, said protective area including a protective strip extending substantially throughout the length of the enclosure along each long edge thereof and along said front and rear panels for protecting the strip of encoded data regardless of the orientation of the card in the enclosure.

2. The holding device as defined in claim 1 wherein each protective strip includes a high permeability metallic strip, the front and rear panels of said enclosure being constructed of inner and outer layers with the strips sealed between the inner and outer layers in each of said panels adjacent each long edge of said panels.

3. The holding device as defined in claim 1 wherein each of said front and rear panels includes a longitudinally extending centrally disposed transparent area to enable observation of indicia on the encoded card in registry with the transparent areas.

4. The holding device as defined in claim 1 and further including a third transparent panel forming a pocket with said rear panel for removably inserting an informational card in said holder.

5. The holding device as defined in claim 2 wherein the front and rear panels forming the enclosure each includes an opaque area extending longitudinally substantially throughout the length of the enclosure, said opaque area extending along the length of a top and bottom edge area of each of said panels to cover said metallic strip and provide a space for printing of indicia.

6. The holding device as defined in claim 1 wherein said open edge of the enclosure is along one long edge of the enclosure for insertion of said encoded card therein.

7. The holding device as defined in claim 1 wherein said open edge is along a shorter side edge of the enclosure for endwise insertion of said encoded card therein.

8. The holding device as defined in claim 7 wherein the front and rear panels forming the open side edge of the enclosure are each provided with a generally semicircular notch to enable the encoded card to be more easily removed from and inserted into the enclosure.

9. A protective holding device for a member having magnetically encoded data in a specific area thereof, said holding device comprising an enclosure having an open edge receiving said member, said enclosure including a protective area in registry with said specific area having magnetically encoded data for protecting the encoded data from magnetic and electromagnetic fields that could alter said encoded data, said member received in the enclosure being a rectangular encoded card closely fitted into the enclosure, said rectangular card including identifying indicia at a central portion on one surface and a signature area at a similar central portion on the other surface, said enclosure being generally rectangular, and including front and rear panels, each of said panels including a transparent area in registry with said indicia and signature area for observation thereof regardless of the orientation of the encoded card in the enclosure.

10. The holding device as defined in claim 9 wherein each of said front and rear panels includes an opaque area extending longitudinally substantially throughout the length of the enclosure, said opaque area extending along the length of a top and bottom edge area of each of said panels and providing a space for printing of indicia.

11. A protective holding device for a generally rectangular card having magnetically encoded data in a strip extending along the length of the card adjacent a long edge thereof and having identifying indicia on at least one surface of said card out of registry with said encoded data, said holding device comprising a generally rectangular enclosure having front and rear panels forming a sheath-type construction, one edge of said enclosure being open for insertion of said card, said enclosure including a protective strip extending substantially throughout the length of the enclosure along each long edge thereof and along said front and rear panels for protecting the strip of magnetically encoded data regardless of the orientation of the card in the enclosure, at least one of said protective strips including an opaque area for printing of promotional indicia, said enclosure also including at least one transparent area in registry with said identifying indicia for observation thereof when said card is held in the enclosure.

12. The protective holding device as defined in claim 11 wherein each of said protective strips includes an opaque area for printing promotional material.

13. The protective holding device as defined in claim 11 wherein each of said front and rear panels includes a transparent area extending throughout the length of a central portion of each panel in registry with said identifying indicia for observation thereof when said card is held in the enclosure.

14. The protective holding device as defined in claim 11 wherein each protective strip includes a high permeability metallic strip, the front and rear panels of said enclosure being constructed of inner and outer layers with the strips sealed between the inner and outer layers in each of said panels adjacent each long edge of said panels.

15. The protective holding device as defined in claim 11 wherein said enclosure includes a third panel overlying one of said front and rear panels, said third panel including at least a major portion being transparent, said third panel being rectangular and joined with the enclosure along one long edge thereof, said third panel including an open end along at least one short edge of said enclosure forming a pocket for removably inserting an informational card between said third panel and enclosure.

16. The protective holding device as defined in claim 11 wherein said enclosure includes a third panel overlying one of said front and rear panels, said third panel including at least a major portion being transparent, said third panel being rectangular and joined with the enclosure along both long edges thereof and along one short edge thereof, said third panel including an open end along the other short edge of said enclosure forming a pocket for lengthwise insertion and removal of an informational card between said third panel and enclosure, each of said front and rear panels having a generally semicircular notch in one short edge thereof, said third panel having a generally semicircular notch in said one short edge thereof, said notch in said one short edge of said third panel being aligned with said notches in said front and rear panels and opposite the open end of the third panel to provide access to a short edge of said informational card inserted completely into the open end of the third panel to facilitate removal of said informational card out the open end of said third panel.

* * * * *